United States Patent [19]

Watanabe

[11] Patent Number: 4,873,550

[45] Date of Patent: Oct. 10, 1989

[54] ELECTROPHOTOGRAPHIC COPIER INCLUDING MEANS FOR SENSING THE SIZE OF AN ORIGINAL DOCUMENT

[75] Inventor: Toshio Watanabe, Yamato, Japan

[73] Assignee: Ricoh Company, Ltd., Tokyo, Japan

[21] Appl. No.: 168,397

[22] Filed: Mar. 15, 1988

[30] Foreign Application Priority Data

Mar. 26, 1987 [JP] Japan ..... 62-44617[U]

[51] Int. Cl.[4] ..... G03G 15/04

[52] U.S. Cl. ..... 355/232; 355/311

[58] Field of Search ..... 355/8, 14 R, 14 SH, 355/57–58, 3 SH,

[56] References Cited

U.S. PATENT DOCUMENTS

| | | | |
|---|---|---|---|
| 4,209,248 | 6/1980 | Gibson et al. | 355/57 X |
| 4,585,332 | 4/1986 | Shenoy | 355/14 R |
| 4,696,564 | 9/1987 | Watanaba | 355/14 R |
| 4,782,361 | 11/1988 | Spinelli et al. | 355/14 SH X |

FOREIGN PATENT DOCUMENTS

| | | | |
|---|---|---|---|
| 60-70430 | 4/1985 | Japan | 355/14 R |

*Primary Examiner*—Arthur T. Grimley
*Assistant Examiner*—J. Pendegrass
*Attorney, Agent, or Firm*—Oblon, Spivak, McClelland, Maier & Neustadt

[57] ABSTRACT

An electrophotographic copier of the type moving an original document and optics relative to each other to expose a photoconductive element imagewise via the optics to thereby form a latent image on the photoconductive element, developing the latent image to produce a visible image, and transferring the visible image to a paper sheet. The size of an original document which is positioned on a glass platen with one corner portion of the glass platen as a reference is sensed, and a lens included in the optics is displaced in response to the document size sensed. A paper sheet is transported with its center with respect to the widthwise direction registered aligned with the center of an image which is provided on the photoconductive element.

5 Claims, 6 Drawing Sheets

| Fig. 6A |
| --- |
| Fig. 6B |

ELECTROPHOTOGRAPHIC COPIER INCLUDING MEANS FOR SENSING THE SIZE OF AN ORIGINAL DOCUMENT

BACKGROUND OF THE INVENTION

1. Field of the Invention

The present invention relates to an electrophotographic copier of the type moving an original document and optics relative to each other to expose a photoconductive element imagewise via the optics, developing the resulting latent image on the photoconductive element to produce a visible image, and transferring the visible image to a paper sheet. More particularly, the present invention is concerned with an electrophotographic copier which enhances stable transport of a paper sheet and easy positioning of an original document.

2. Discussion of the Background

With a transfer type electrophotographic copier, it is a common practice to position an original document on a glass platen by abutting two perpendicular sides of the document against a front and a side scale of the copier. On the other hand, a paper sheet is transported in matching relation to such a position of the document on the glass platen, i.e., with the back side as a reference point (or with the front side as a reference point when the document is located at the back side). A problem with this kind of transport system is that when all the different sizes of paper sheets are transported by using one side for a reference, some sizes of paper sheets are apt to become unstable during their movement resulting in skewing, jamming and other undesirable occurrences. While this problem may be solved by feeding a paper sheet with its center as a reference point, such a scheme is not practicable unless the document loading position is changed accordingly by troublesome manipulation.

SUMMARY OF THE INVENTION

It is, therefore, an object of the present invention to provide an electrophotographic copier which allows an original document to be positioned at a corner portion of a glass platen while allowing a paper sheet to be transported with its center as a reference point.

It is another object of the present invention to provide a generally improved electrophotographic copier.

In accordance with the present invention, in an electrophotographic copier wherein an original document laid on a glass platen and optics assembly which includes a lens are movable relative to each other to expose a photoconductive element imagewise via the optics, and a resulting latent image produced on the photoconductive element is developed to become a visible image which is then transferred to the paper sheet, there are provided document size sensing means for sensing a size of the document which is positioned with one corner portion of the glass platen as a reference, and lens displacing means for changing the position of the lens of the optics assembly based on the document size sensed by the document size sensing means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
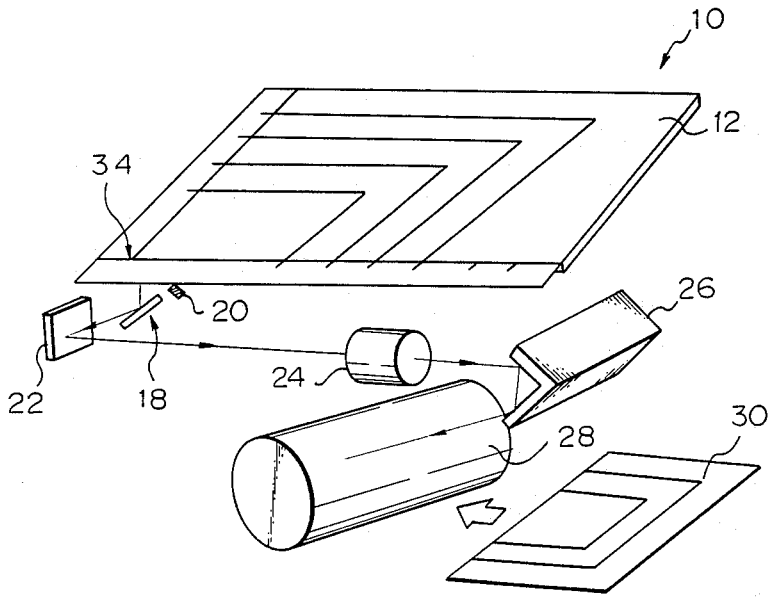
FIG. 1 is a schematic perspective view of an electophotographic copier embodying the present invention.
Figure 2:
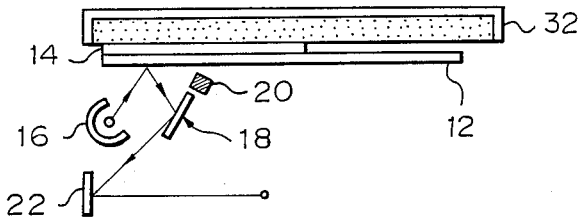
FIG. 2 is a front view showing details of a document reading section included in the copier of FIG. 1.

Referring to FIGS. 1 and 2, an electrophotographic copier embodying the present invention is shown and generally designated by the reference numeral 10. As shown, the copier 10 includes a glass platen 12 on which an original document 14 is laid. A light source 16 is provided for illuminating the document 14 while a scanner 18 is provided for reflecting in a predetermined direction light which is reflected by the document 14. A document size sensor 20 is provided on the scanner 18 to sense the size of the document 14. The light reflected by the scanner 18 is reflected by a movable mirror 22. Also shown in the drawings are a lens 24 for focusing the light from the movable mirror 22 to a predetermined position, a mirror 26 for reflecting the light from the lens 24, a photoconductive element 28 to be exposed to the light from the mirror 26 to form a latent image thereon, a tray 30 loaded with a paper sheet, and a cover 32 associated with the glass platen 12.

In operation, prior to an actual copying cycle, the scanner 18 is moved forward and then backward over the entire length in the subscanning direction, so that the size of the document 14 which is positioned with a corner portion 34 of the glass platen 12 as a reference is sensed by the sensor 20. Then, the lens 24 is moved based on the document size sensed and in a direction perpendicular to the optical path. Upon starting of a copying cycle, the light source 16, scanner 18 and movable mirror 22 scan the document 14 integrally with each other. The light reflected by the document 14 is transmitted through the lens 24 and then reflected by the mirror 26 to reach the photoconductive element 28, which is rotated in synchronism with the movement of the scanner 18. Consequently, the photoconductive element 28 is sequentially exposed imagewise by an amount corresponding to one document 14. A latent image formed on the element 28 by such a procedure is developed by a developing unit, not shown, to become a toner image. The toner image is transferred to a paper sheet by a transfer device, not shown, and fixed on that paper sheet by a fixing unit, not shown. As shown in FIG. 1, while various sizes of paper sheets may be selectively fed in register with individual scales which are provided on the sheet loading surface of the tray 30, the different scales are defined sharing the same centerline.

Figure 3:
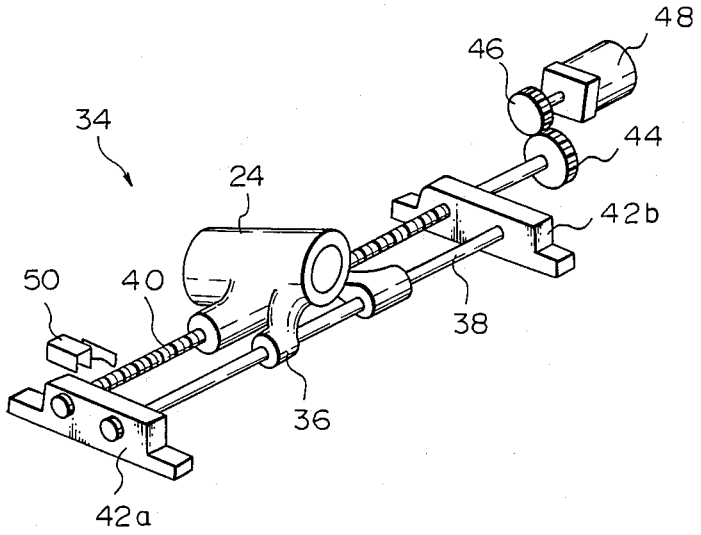
FIG. 3 is a perspective view of a mechanism for driving a lens which is also included in the copier of FIG. 1.

Referring to FIG. 3, a mechanism 34 for driving the lens 24 is shown and includes a guide rail 38 on which a casing 36 of the lens 24 is mounted. A feed screw 40 extends parallel to the guide rail 38 and is rotatably supported by holders 42*a* and 42*b*. Opposite ends of the guide rail 38 are individually fixed to the holders 42*a* and 42*b*. A gear 44 is mounted on one end of the feed screw 40 while a gear 46 is held in constant mesh with the gear 44. A stepping motor 48 has an output shaft on which the gear 46 is mounted. A lens home position sensor 50 is provided for determining whether the lens 24 is located at its home position. When the document size sensor 20 senses the size of the document 14, a controller 52 (FIG. 5) which will be described applies to the stepping motor 48 pulses, the number of which is associated with the document size. Therefore, the lens 24 is moved away from the home position and then stopped at a predetermined position. When the size of the document 14 is changed, the lens 24 is once returned to the home position before it is moved to a particular position which is associated with the new document size.

Figure 4:
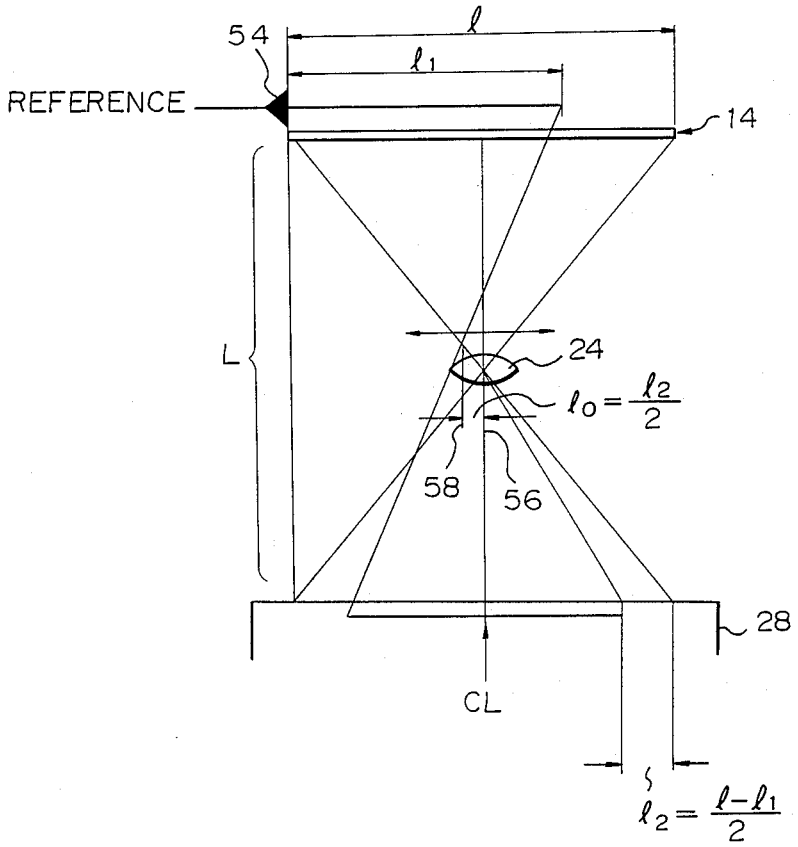
FIG. 4 is a diagram schematically showing a relationship between the displacement of the lens and the paper size.

FIG. 4 shows a relationship between the displacement of the lens 24 and the size of the document 14. As shown, a reference point 54 for the document 14 is provided at one side of the width l of a document having the largest size which is usable with the copier 10. In this condition, the lens 24 is present on a line 56 such that an image is focused to the center of the photoconductive element 28 with respect to the widthwise direction of the element 28 and transport system. Assume that a document 14 having a width of $l_1$ is positioned in register with the reference point 54. Then, if the image of the document 14 which is $l_1$ wide is focused on the photoconductive element 28 such that one side of the image is located at a position $l_2$ which is produced by an equation $l_2=(l-l_1)/2$, the centerline CL of the image is successfully aligned with the centerline of the document 14 of the largest size. This can be done simply by locating the lens 24 on a line 58 which is away from the line 56 by $l_0=l_2/2$. In the figure, the distance between the document 14 and the surface of the photoconductive element 28 is designated by L.

Figure 5:
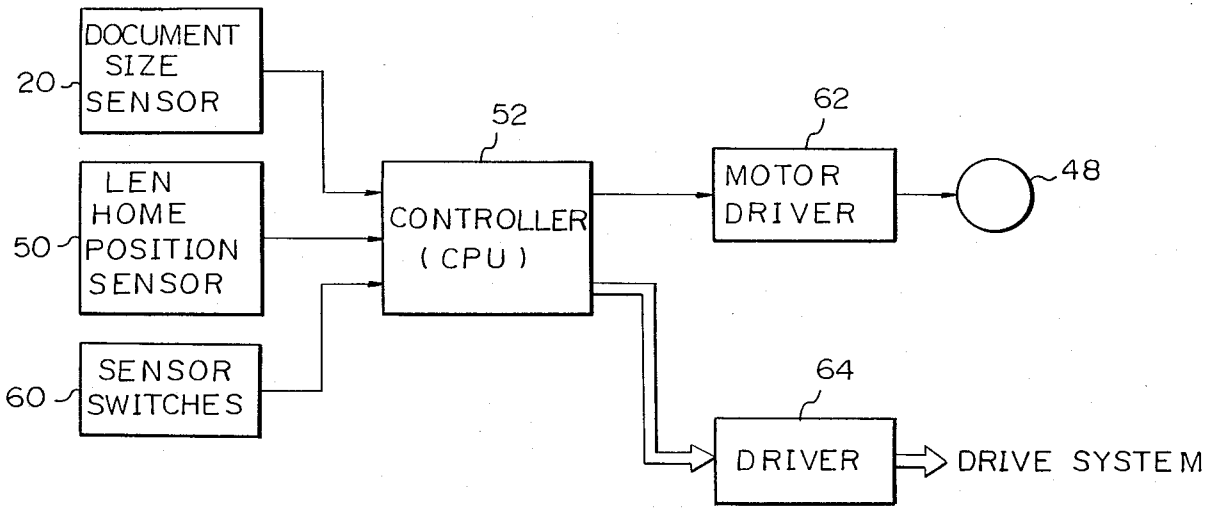
FIG. 5 is a schematic block diagram representative of a control system installed in the copier of FIG. 1; and, which is composed of FIGS. 6A and 6B, FIG. 6, is a flowchart demonstrating a specific operation of the control system as shown in FIG. 5.

Referring to FIG. 5, a control system installed in the copier 10 includes the previously stated controller 52 which is adapted to execute lens drive control and copy control in accordance with the present invention and mainly constituted by a microcomputer (CPU). Output signals of the document size sensor 20, lens home position sensor 50 and various sensor switches 60 are digitized and then applied to the controller 52. The control system further includes a motor drive 62 responsive to a command from the controller 52 for driving the stepping motor 48, and a driver 64 associated with a print motor, relay, solenoid and others for driving them in response to a command from the controller 52. The controller 52 is provided with an input interface, memory and output interface in addition to the CPU.

Figures 6, 6A:
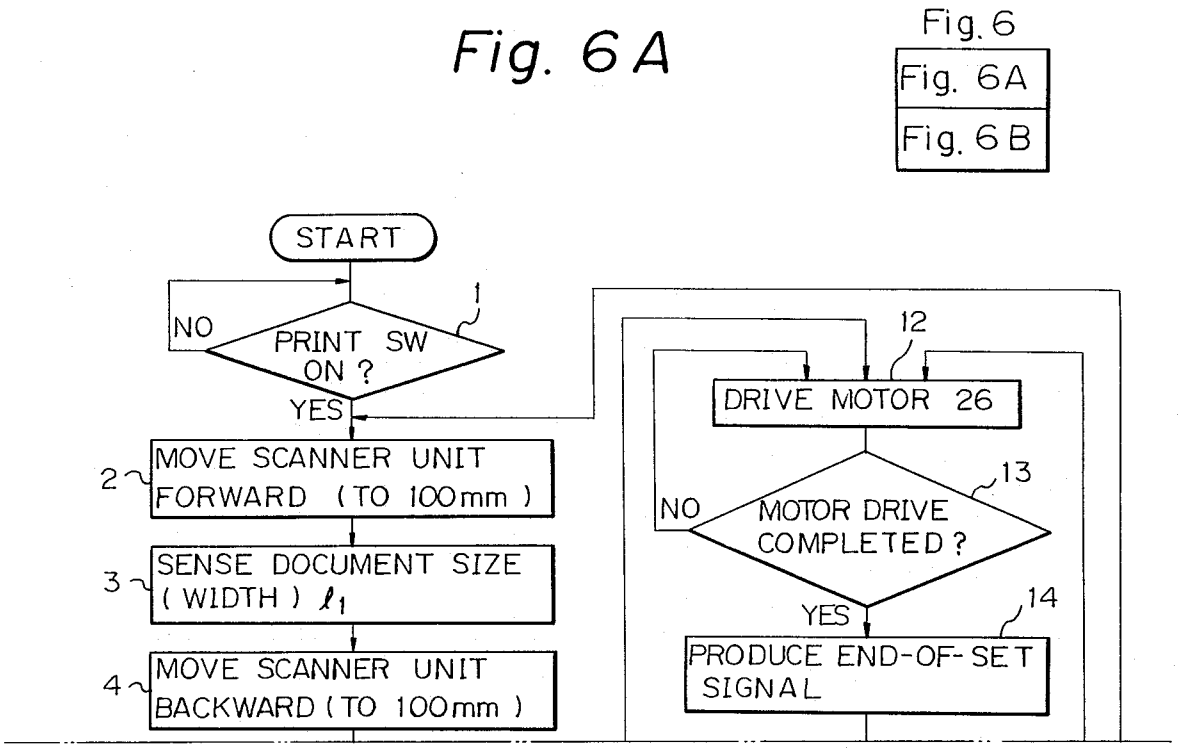
Figure 6B:
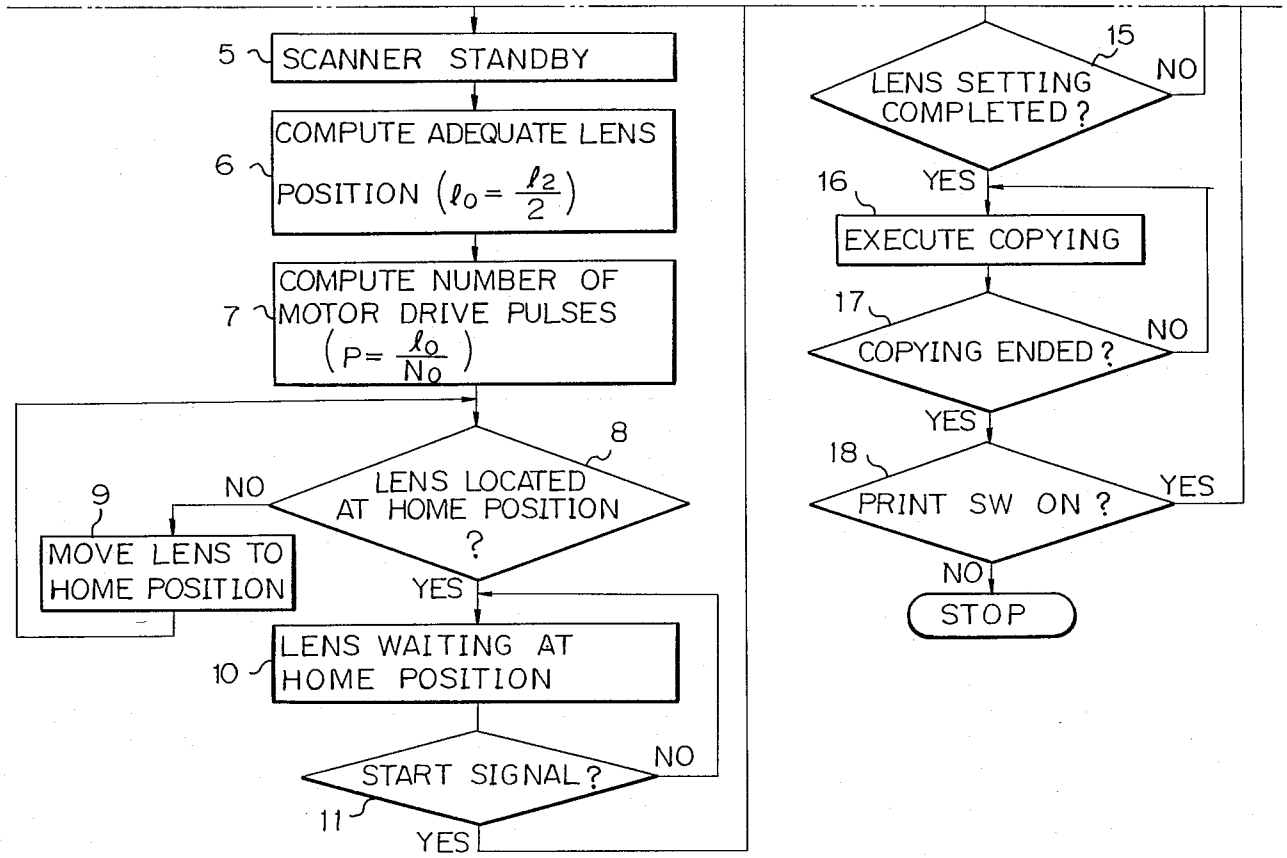

FIG. 6 is a flowchart demonstrating a specific operation of the control system as shown in FIG. 5. As shown, when a main switch of the copier 10 is turned on (step 1), the scanner 18 performs one reciprocation over a dimension which corresponds to the largest document width (steps 2 and 4), causing the document size sensor 20 to sense the document size $l_1$ (step 3). After one reciprocation, the scanner 18 remains in a standby condition (step 5). Then, the controller 52 computes an adequate lens position $l_0$ based on the output of the sensor 20 (step 6) while, at the same time, computing the number of pulses for driving the motor 48 to move the lens 24 to that position $l_0$ (step 7). Subsequently, the controller 52 determines whether the lens 24 is at its home position (step 8) and, if not, drives the motor 48 until the lens home position sensor 50 senses the lens 24 (step 9). If the lens 24 is located at the home position, the controller 52 causes it to wait at the home position (step 10).

In the above condition, the controller 52 determines if a start signal has been generated (step 11). Upon the generation of a start signal, the controller 52 delivers to the motor 48 the number of pulses as decided by the step 7 (step 12) so as to move the lens 24 to the position which is associated with the document size. When the motor 48 is fully driven (step 13), the controller 52 produces an end-of-set signal (step 14). After this end-of-set signal has been confirmed (step 15), a copying cycle is executed (step 16). If the lens 24 has not been set as decided by the step 15, the controller 52 repeats the sequence of steps 12 to 14. When the controller 52 decides that the copying cycle has been completed, it again determines whether the print switch is turned on (step 18) and, if it is turned on, repeats the step 2 and onward.

In summary, it will be seen that the present invention provides an electrophotographic copier which promotes easy positioning of an original document and stable transfer of a paper sheet and which eliminates jamming, skewing and other occurrences.

Various modifications will become possible for those skilled in the art after receiving the teachings of the present disclosure without departing from the scope thereof.

What is claimed is:

1. An electrophotographic copier in which an original document laid on a glass platen and optics assembly, which includes a lens, are movable relative to each other to expose a photoconductive element imagewise via the optics assembly, and a resulting latent image produced on said photoconductive element is developed to become a visible image which is then transferred to a paper sheet, said copier comprising:

document size sensing means for sensing a size of said document which is positioned at one corner portion of said glass platen;

means for transporting said paper sheet with its center as a reference point; and lens displacing means for changing a first position of said lens of said optics assembly to a second position based on said document size sensed by said document size sensing means.

2. An electrophotographic copier as claimed in claim 1, wherein said lens displacing means comprises lens driving means for moving said lens.

3. An electrophotographic copier as claimed in claim 2, wherein said lens driving means comprises a stepping motor.

4. An electrophotographic copier as claimed in claim 2, wherein said lens displacing means further comprises a lens home position sensor responsive to said home position of said lens.

5. An electrophotographic copier in which an original document laid on a glass platen and optics assembly, which includes a lens, are movable relative to each other to expose a photoconductive element imagewise via the optics assembly, and a resulting latent image produced on said photoconductive element is developed to become a visible image which is then transferred to a paper sheet, said copies comprising:

document size sensing means for sensing a size of said document which is positioned at one corner of said glass platen; and lens displacing means for changing a first position of said lens of said optics assembly to a second position based upon said document size sensed by said document size sensing means wherein said lens is displaced only in a direction substantially perpendicular to the optical path.

* * * * *